US012006720B2

(12) United States Patent
Stucchi

(10) Patent No.: US 12,006,720 B2
(45) Date of Patent: Jun. 11, 2024

(54) ANCHORING ASSEMBLY AND ASSOCIATED FENCING

(71) Applicant: SATECH SAFETY TECHNOLOGY S.P.A., Milan (IT)

(72) Inventor: Marco Stucchi, Civate (IT)

( * ) Notice: Subject to any disclaimer, the term of this patent is extended or adjusted under 35 U.S.C. 154(b) by 388 days.

(21) Appl. No.: 17/611,437

(22) PCT Filed: May 14, 2019

(86) PCT No.: PCT/IT2019/000034

§ 371 (c)(1),
(2) Date: Nov. 15, 2021

(87) PCT Pub. No.: WO2020/230173

PCT Pub. Date: Nov. 19, 2020

(65) Prior Publication Data

US 2022/0259888 A1 Aug. 18, 2022

(51) Int. Cl.
*E04H 17/16* (2006.01)
*E04H 17/10* (2006.01)

(52) U.S. Cl.
CPC ..... *E04H 17/161* (2013.01); *E04H 17/124* (2021.01)

(58) Field of Classification Search
CPC ..... E04H 17/02; E04H 17/05; E04H 17/10; E04H 17/12; E04H 17/124; E04H 17/14; E04H 17/16; E04H 17/161; E04H 17/163; E04H 17/17; E04H 17/24
See application file for complete search history.

(56) References Cited

U.S. PATENT DOCUMENTS 5,542,649 A * 8/1996 Allegaert ..... E04H 17/161 256/54
5,746,040 A * 5/1998 Young ..... E04H 17/16 52/285.3

(Continued)

FOREIGN PATENT DOCUMENTS

DE 3937791 C1 5/1991
DE 4436345 C1 * 2/1996 ..... E04H 17/161

(Continued)

OTHER PUBLICATIONS

International Search Report dated Oct. 1, 2020 re: Application No. PCT/IT2019/000034, pp. 1-4.

(Continued)

*Primary Examiner* — Jonathan P Masinick
(74) *Attorney, Agent, or Firm* — CANTOR COLBURN LLP

(57) ABSTRACT

An anchoring assembly for enclosures that includes at least one laminar screen, which has at least one rigid wire, and at least one post, for supporting the screen with vertical orientation. The assembly has at least one pin provided with a head and with a shank, the shank being configured to be inserted into a hole in the post. The assembly further includes at least one clamp that has a recess configured to receive the shank with interference. The rigid wire can be clamped in the clamp. The assembly also includes at least one at least partially threaded stem, which can be screwed into a female thread which is provided inside the pin, with consequent mutual tightening of the clamp.

13 Claims, 10 Drawing Sheets

(56) References Cited

U.S. PATENT DOCUMENTS

| | | | | | |
|---|---|---|---|---|---|
| 6,010,116 | A * | 1/2000 | Knott, Sr. | ..... | E04H 17/161 256/73 |
| 8,540,217 | B2 * | 9/2013 | Olsson | ..... | E04H 17/12 256/48 |
| 10,689,879 | B2 * | 6/2020 | Messelis | ..... | F41H 5/013 |
| 2014/0318891 | A1 * | 10/2014 | Crothers | ..... | E04G 5/067 182/113 |
| 2016/0083974 | A1 * | 3/2016 | Meza | ..... | E04H 17/17 248/219.4 |
| 2022/0412121 | A1 * | 12/2022 | Bengtsson | ..... | E04H 17/163 |

FOREIGN PATENT DOCUMENTS

| | | | | | |
|---|---|---|---|---|---|
| DE | 102011017437 | A1 * | 12/2011 | ..... | E04H 17/161 |
| DE | 102013004915 | B4 * | 1/2017 | ..... | E04H 17/161 |
| EP | 3045616 | A1 * | 7/2016 | ..... | E04H 17/161 |
| FR | 2856717 | A1 | 12/2004 | | |
| WO | WO-2008154661 | A2 * | 12/2008 | ..... | E04H 17/161 |

OTHER PUBLICATIONS

Written Opinion dated Oct. 1, 2020 re: Application No. PCT/IT2019/000034, pp. 1-5.

* cited by examiner

ANCHORING ASSEMBLY AND ASSOCIATED FENCING

TECHNICAL FIELD

The present disclosure relates to an anchoring assembly and to an associated fencing.

BACKGROUND

In industry, the need often arises to install protective enclosures (or barriers) along the perimeter of industrial machines and/or to delimit specific operational areas. This in fact makes it possible to prevent or discourage access by unauthorized persons and to reduce the risk of distracted operators from suffering injury or harm, as a result of contact with or in proximity to elements in motion or in any case with devices that carry out processes that are potentially hazardous to humans.

Enclosures are therefore well known which are constituted by one or more laminar screens (be they continuous panels or reticular grilles), which are kept vertical by respective supporting posts, arranged at the sides.

To ensure the necessary versatility and enable the user or the installation technician to provide the configuration that is appropriate in each instance, usually the enclosures described above are modular, and are assembled starting from kits that comprise a plurality of screens and posts (and corresponding accessories) which can be combined in various ways, in order to deploy the fencing along the perimeter of interest.

Among the other accessories, the kit includes a plurality of anchoring elements, which make it possible to mutually anchor each screen to the posts that support it at the sides, using paired threaded elements, hooks and/or clamps. In such context, it is therefore the task of the installation technician to use such anchoring assemblies to anchor each screen to the respective posts and so provide, progressively, the fencing.

Such implementation solution is however not devoid of drawbacks.

First of all, the need is felt to identify increasingly more practical anchoring elements, in order to speed up the operations of assembly and installation of the fencing (and, similarly, the operations of disassembly, if any).

Furthermore, the reference standards require the use of "captive" anchoring elements, which prevent or reduce the risk that the elements specifically used to mutually anchor posts and screens can accidentally detach during the steps of installation or disassembly (or during use). Likewise, it must be impossible to obtain or remove the anchoring without using a tool.

It is even more important to emphasize that many conventional solutions are poorly (or not at all) adapted for use in the food sector: industrial buildings in which foods and beverages are processed are in fact subject to particularly stringent hygienic regulations, to which the enclosures described herein must also evidently adhere. In such context, in order to reduce the risk of bacterial contamination and accumulation of dirt, the components of the fencing must be easily washable and the extent of the contact surfaces, and also of the horizontal surfaces, must be as reduced as possible.

SUMMARY

The aim of the present disclosure is to solve the above mentioned problems, by providing an anchoring assembly that ensures practical and secure methods of assembly of enclosures or barriers.

Within this aim, the disclosure provides a fencing that ensures practical and secure methods of mutual anchoring between screens and associated posts.

The disclosure also provides an assembly that ensures the possibility of providing enclosures that are suitable for use in buildings intended to be used in the food sector.

The disclosure further provides an anchoring assembly that is captive, thus reducing or eliminating the risk of accidental disengagement and/or loss of its components.

The disclosure provides an anchoring assembly that ensures a high reliability and versatility of operation and which can be activated or deactivated only with a tool.

The disclosure provides an assembly and a fencing that adopt an alternative technical and structural architecture to conventional ones.

The disclosure also provides an assembly and a fencing that can be easily provided starting with elements and materials readily available on the market.

The disclosure further provides an assembly and a fencing that are of low cost and safely applied.

This aim and these and other advantages which will become better apparent hereinafter are achieved by providing an assembly, a fencing, and a kit.

BRIEF DESCRIPTION OF THE DRAWINGS

Further characteristics and advantages of the disclosure will become better apparent from the detailed description that follows of a preferred, but not exclusive, embodiment of the assembly and of the fencing according to the disclosure, which is illustrated by way of non-limiting example in the accompanying drawings, wherein.

DETAILED DESCRIPTION OF THE DRAWINGS

Figure 1:
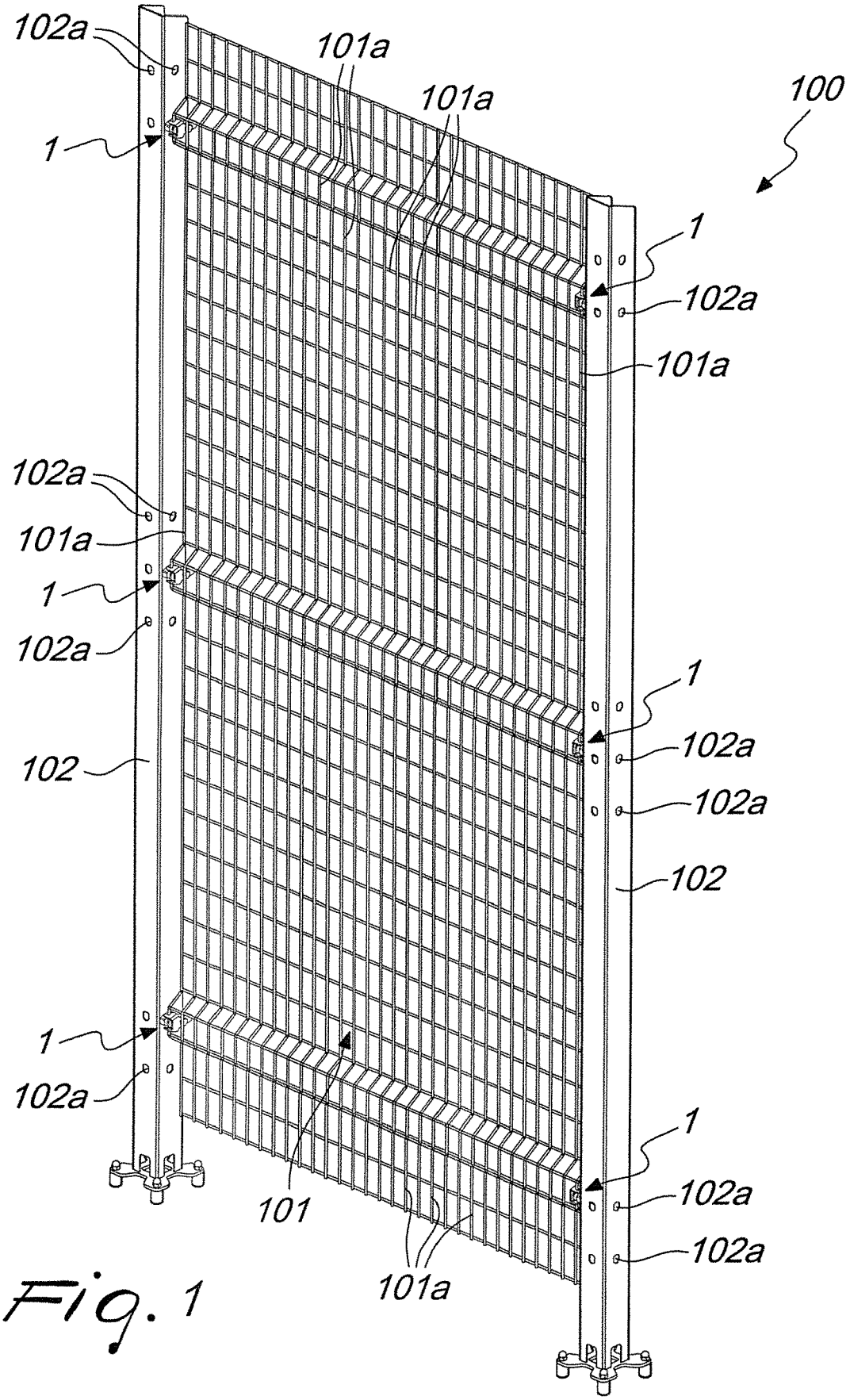
FIG. 1 is a perspective view of the fencing according to the disclosure, provided with six anchoring assemblies according to the disclosure.

With particular reference to the figures, the reference numeral 1 generally designates an anchoring assembly for enclosures 100.

It is to be noted from this point onward that both the assembly 1 and the fencing 100 constitute the subject matter of the present discussion and of the protection claimed herein.

In the preferred, non-exclusive, application, the fencing 100 is intended to be deployed along a perimeter of interest, typically in an industrial building, in order to delimit a specific area and prevent or in any case control access to it, for example to guard against or reduce the risk that individuals could accidentally come into contact with potentially hazardous machinery or that, conversely, the individuals themselves could damage sophisticated and delicate machinery. It is emphasized however that the purposes for which the barrier 100 is deployed along the perimeter of interest may be any, while remaining within the scope of protection claimed herein.

The fencing 100 with which the assembly 1 is intended to be used comprises first of all at least one laminar screen 101, which has at least one rigid wire 101*a*, and at least one post 102, for supporting the screen 101 with vertical orientation. The screen 101 can indeed be positioned, vertically, facing and proximate to the machinery or in any case along the perimeter of interest, on the perimeter of the area to be delimited.

Preferably, the fencing 100 will be provided with at least two posts 102, which, as in the accompanying FIG. 1, support the screen 101 at each side (at a respective wire 101*a*). The possibility is not ruled out however of using a single post 102 associated with one side of the screen 101, the other side being supported by a different structure.

It should likewise be noted that in the preferred application (as in the accompanying figures) the screen 101 is constituted by a grille of rigid wires 101*a* (or bars, or the like), which are made for example of iron or other metallic materials or even of a polymeric material. In such context, and in the methods that will be illustrated below, the anchoring assembly 1 typically acts on the outermost vertical wire 101*a* (as in the accompanying figures), but the possibility is not ruled out of having it interact with another vertical wire 101*a* (for example one of the next innermost ones) or even with a horizontal wire 101*a*. The screen 101 can also have a different structure, for example comprising a panel provided with a single wire 101*a* on a side, in order to allow interaction with the assembly 1.

Figure 3:
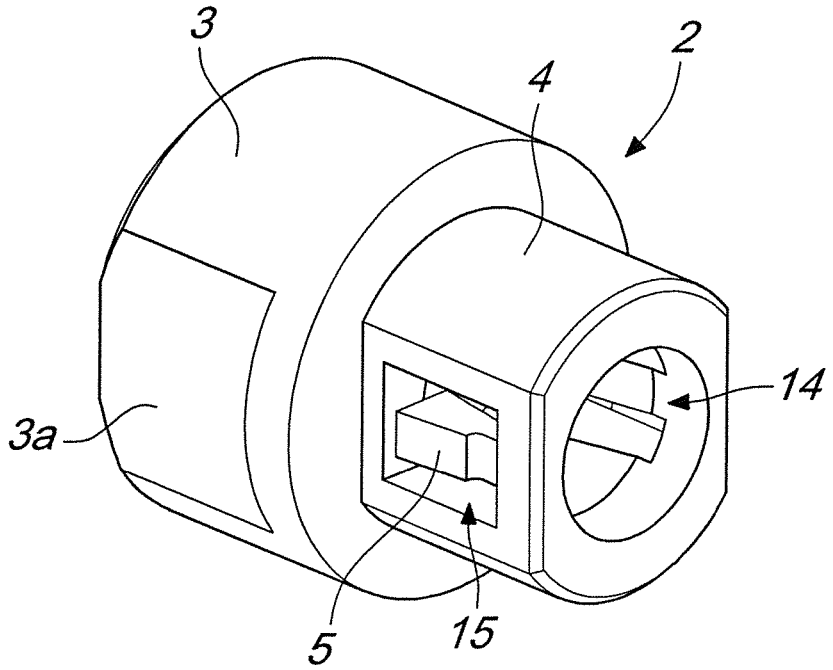
FIG. 3 is a perspective view of a pin of the anchoring assembly according to the disclosure.
Figure 4:
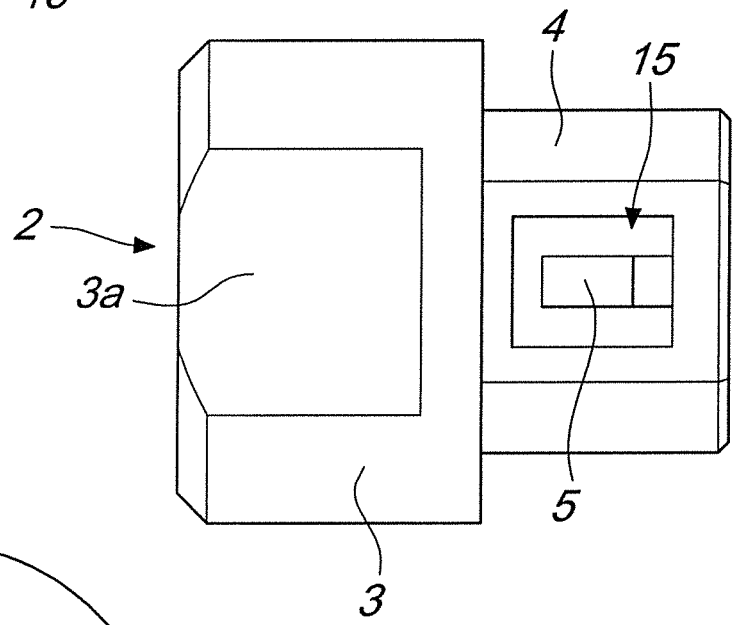
FIG. 4 is a side view of the pin in FIG. 3.
Figure 5:
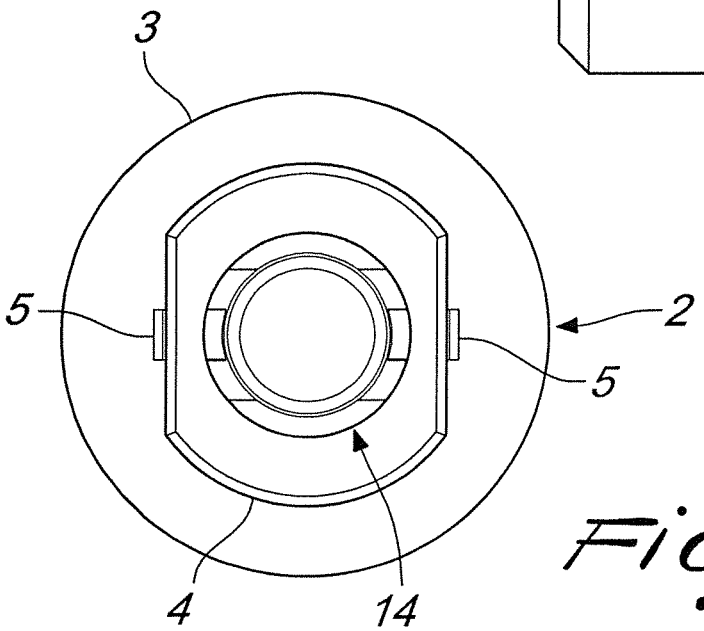
FIG. 5 is a plan view of the pin in FIG. 3.
Figure 6:
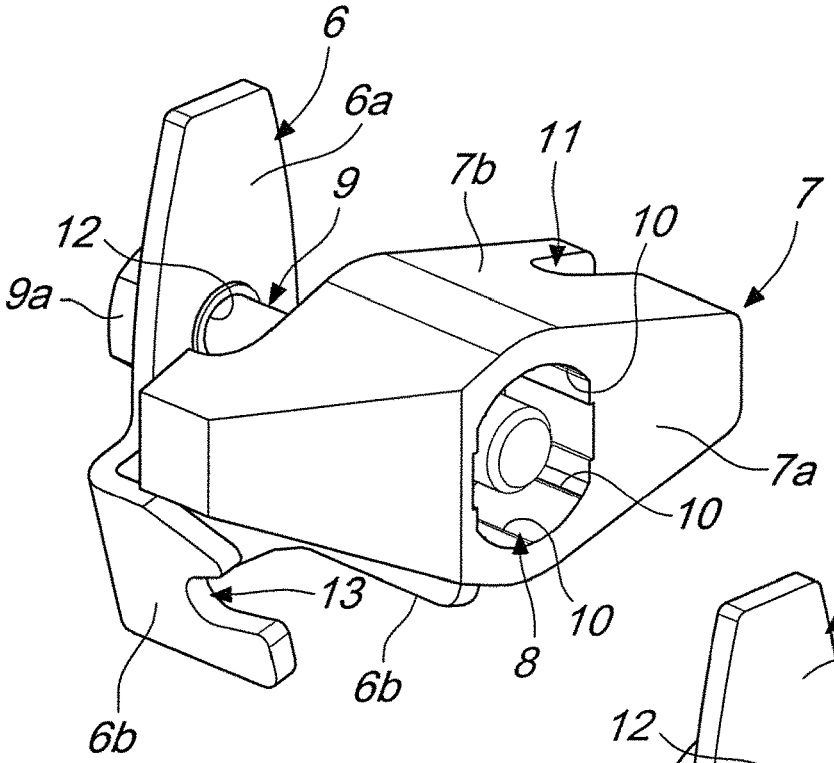
FIGS. 6 and 7 are mutually opposite perspective views of a clamp and a stem of the anchoring assembly according to the disclosure.
Figure 7:
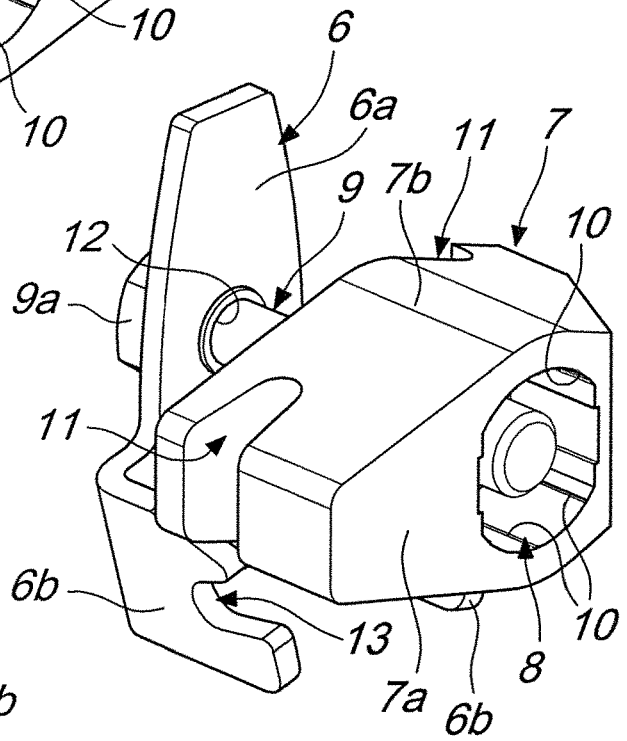
Figure 8:
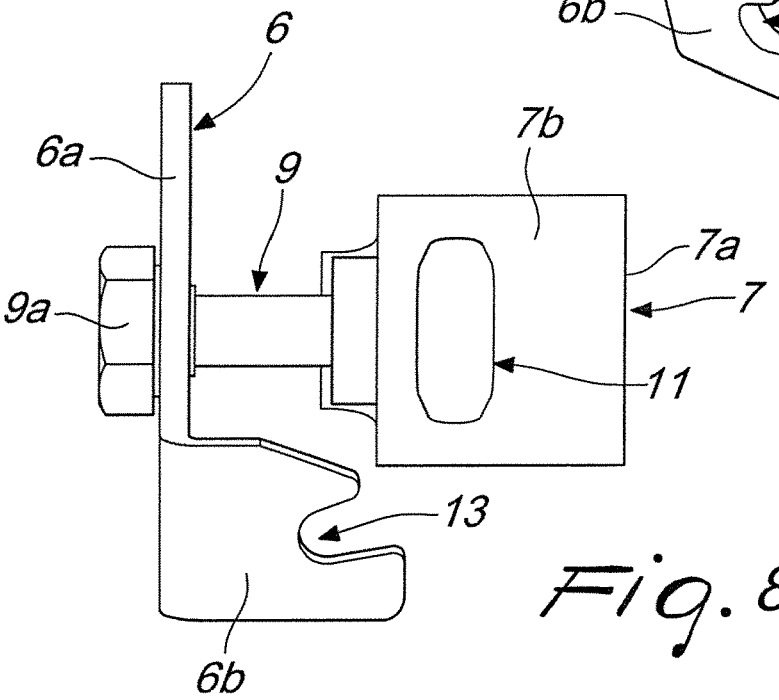
FIG. 8 is a side view of the components in FIGS. 6 and 7.
Figure 9:
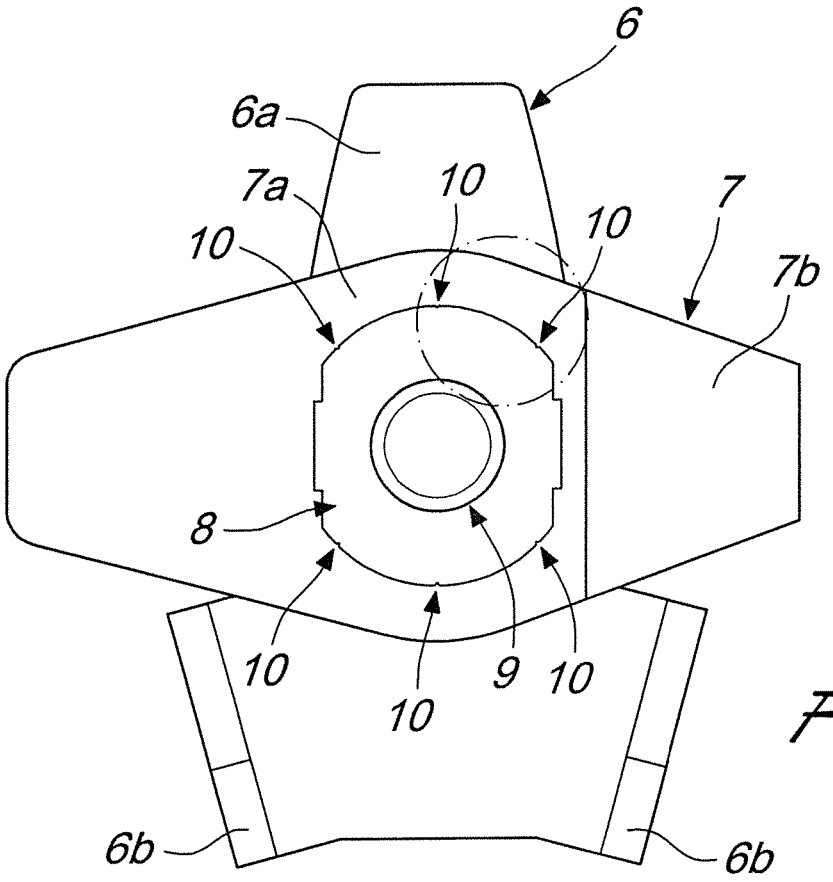
FIG. 9 is a plan view of the components in FIGS. 6 and 7.
Figure 10:
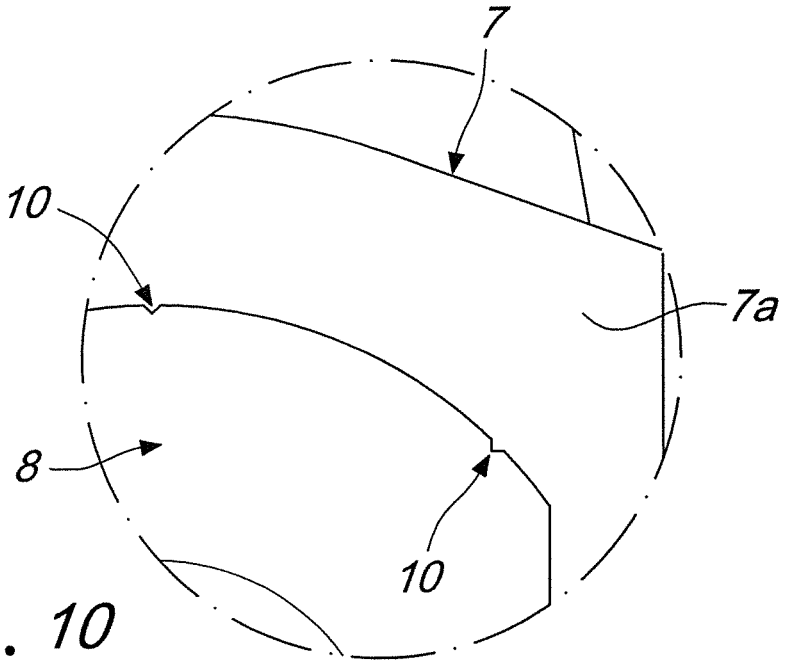
FIG. 10 is a greatly enlarged detail of FIG. 9.
Figure 11:
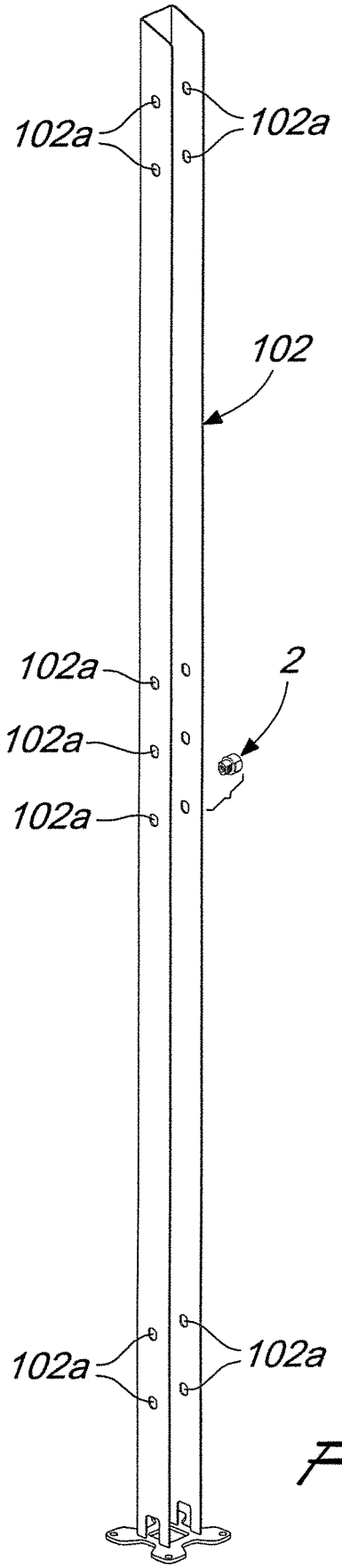
FIG. 11 is a perspective view of the pin in FIG. 3, adapted for coupling to a post.
Figure 12:
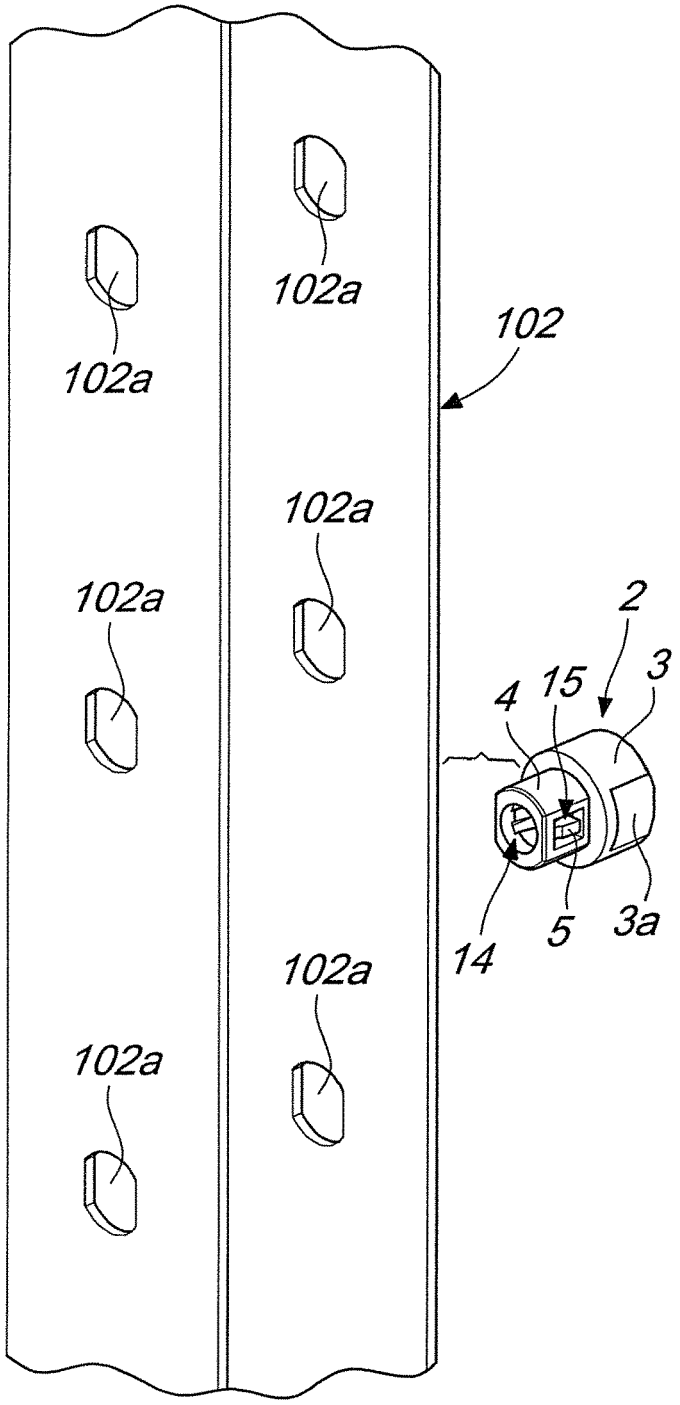
FIG. 12 is a greatly enlarged detail of FIG. 11.

According to the disclosure, the assembly 1 comprises at least one pin 2 (shown specifically in FIGS. 2-4) which is provided with a head 3 and a shank 4. The shank 4 is configured to be inserted into a hole 102*a* which is provided along the post 102, until the head 3 abuts on the post 102 and an end portion of that shank 4 exits on the opposite side. In other words, and as can be clearly seen for example in FIG. 5, the transverse cross-section of the shank 4 is chosen to be of such dimensions as to allow insertion into the hole 102*a*, while this insertion of the head 3 is prevented, which has an enlarged transverse cross-section (with respect to the shank 4 and to the hole 102*a*). At the same time, the length of the shank 4 (measured along the ideal direction of insertion into the hole 102*a*) is such that when the head 3 abuts against the post 102, the shank 4 exits partially from the other side with an end portion thereof (the length of which can constitute a fraction of extent chosen at will with respect to the overall length of the shank 4).

In order to allow greater versatility of use and offer different operative positions of the assembly 1 (or the possibility of using multiple assemblies 1 for the same screen 101), numerous holes 102*a* are provided along the post 102.

Figure 14:
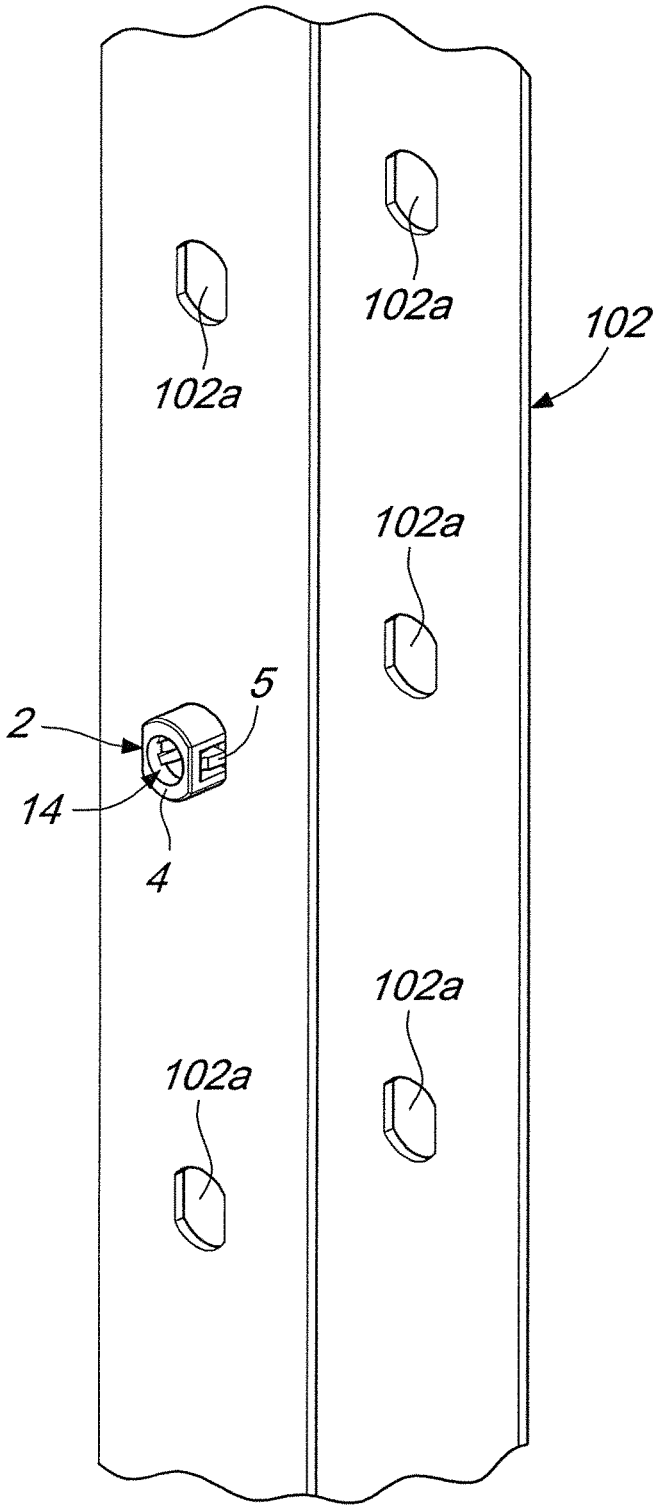
FIG. 14 is a greatly enlarged detail of FIG. 13.
Figure 15:
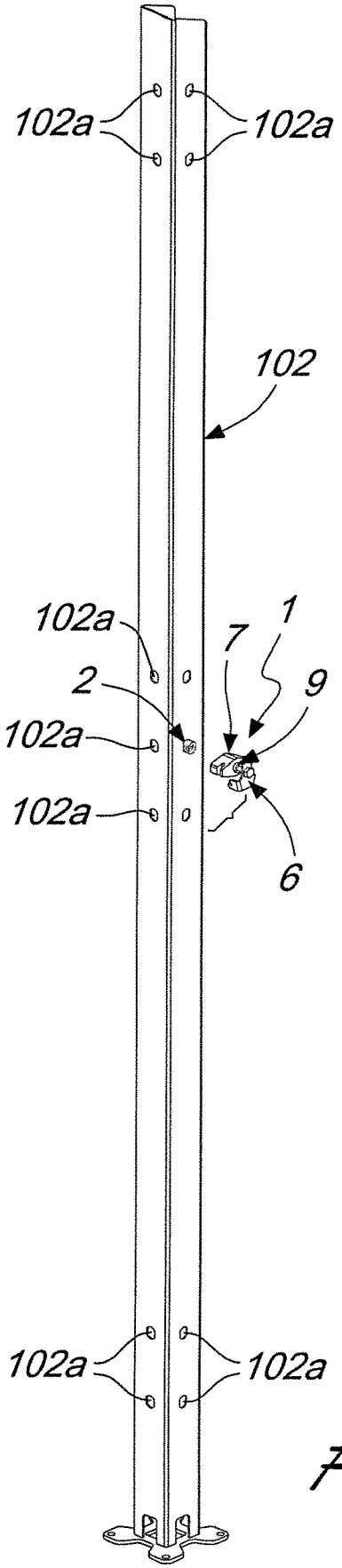
FIG. 15 is a perspective view of a second intermediate step of using an anchoring assembly to assemble the fencing in FIG. 1.
Figure 16:
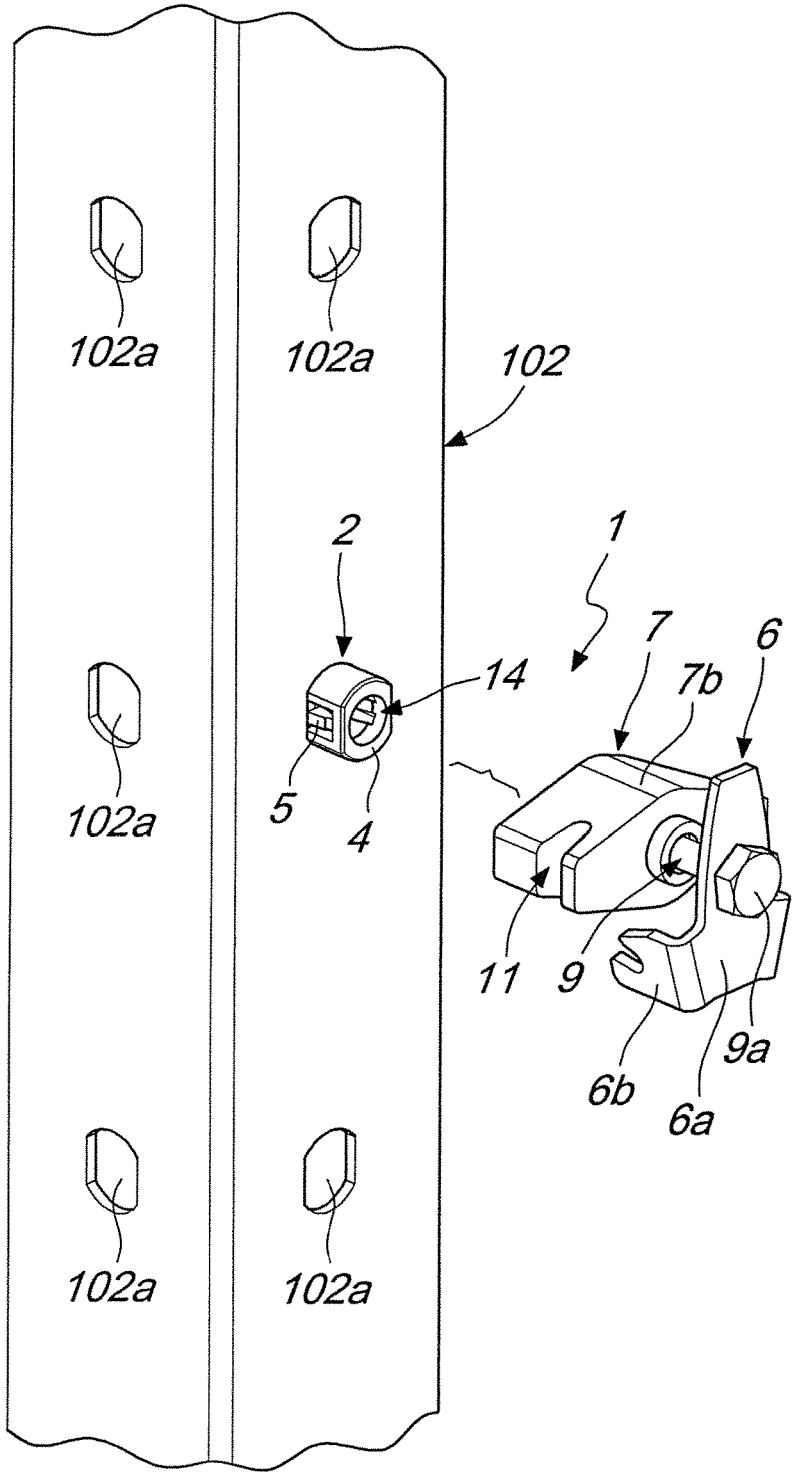
FIG. 16 is a greatly enlarged detail of FIG. 15.
Figure 17:
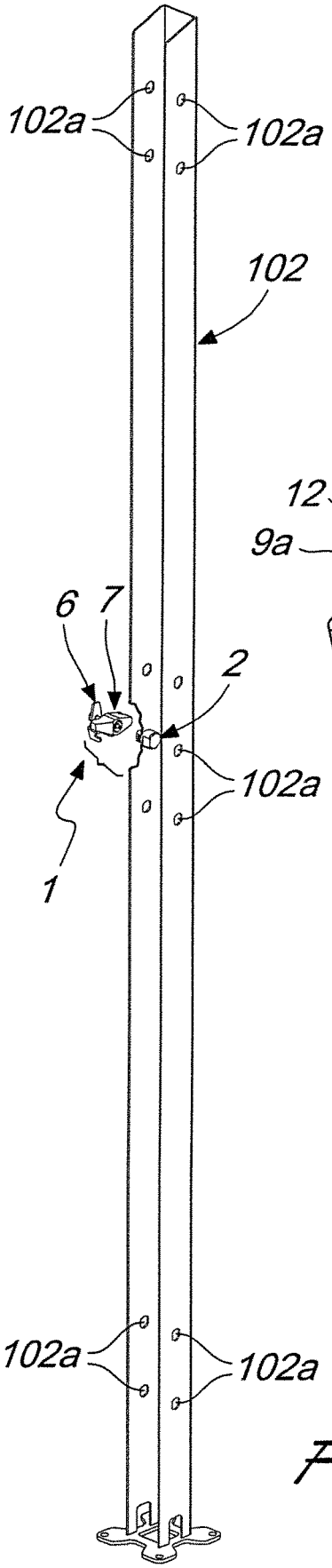
FIG. 17 is a perspective view opposite from the view in FIG. 15 showing the second intermediate step of using the anchoring assembly.
Figure 18:
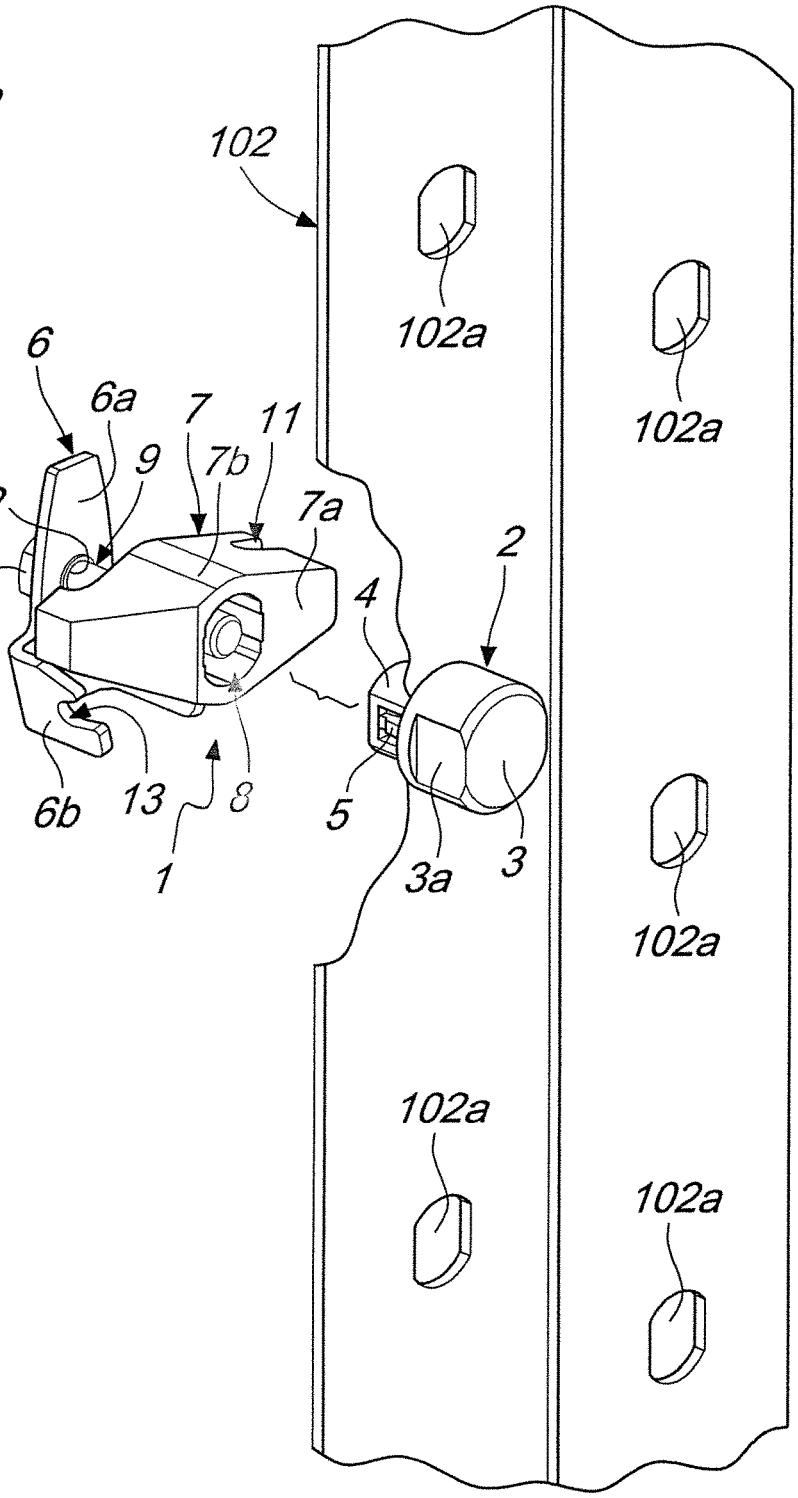
FIG. 18 is a greatly enlarged detail of FIG. 17.
Figure 19:
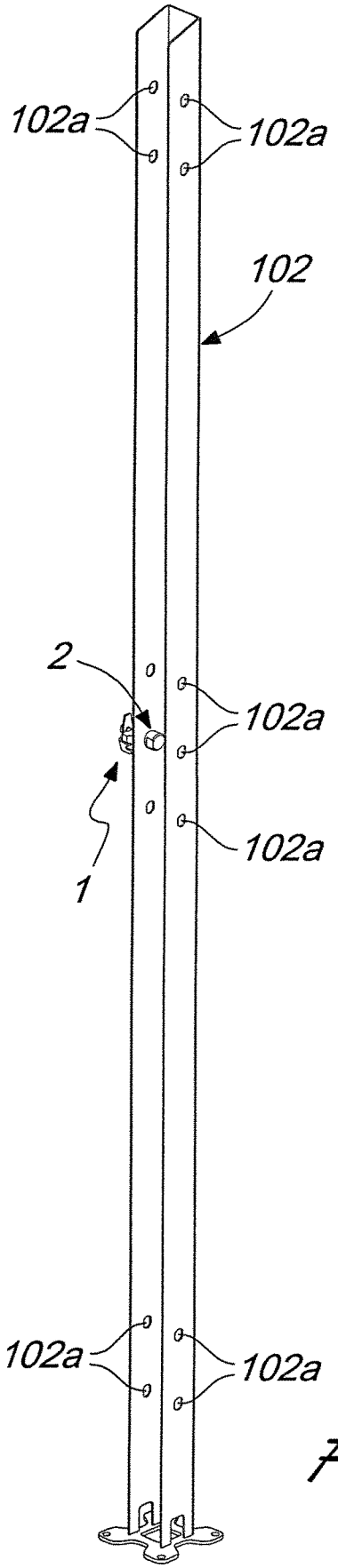
FIG. 19 is a perspective view of a third step of using an anchoring assembly to mount the fencing in FIG. 1.
Figure 20:
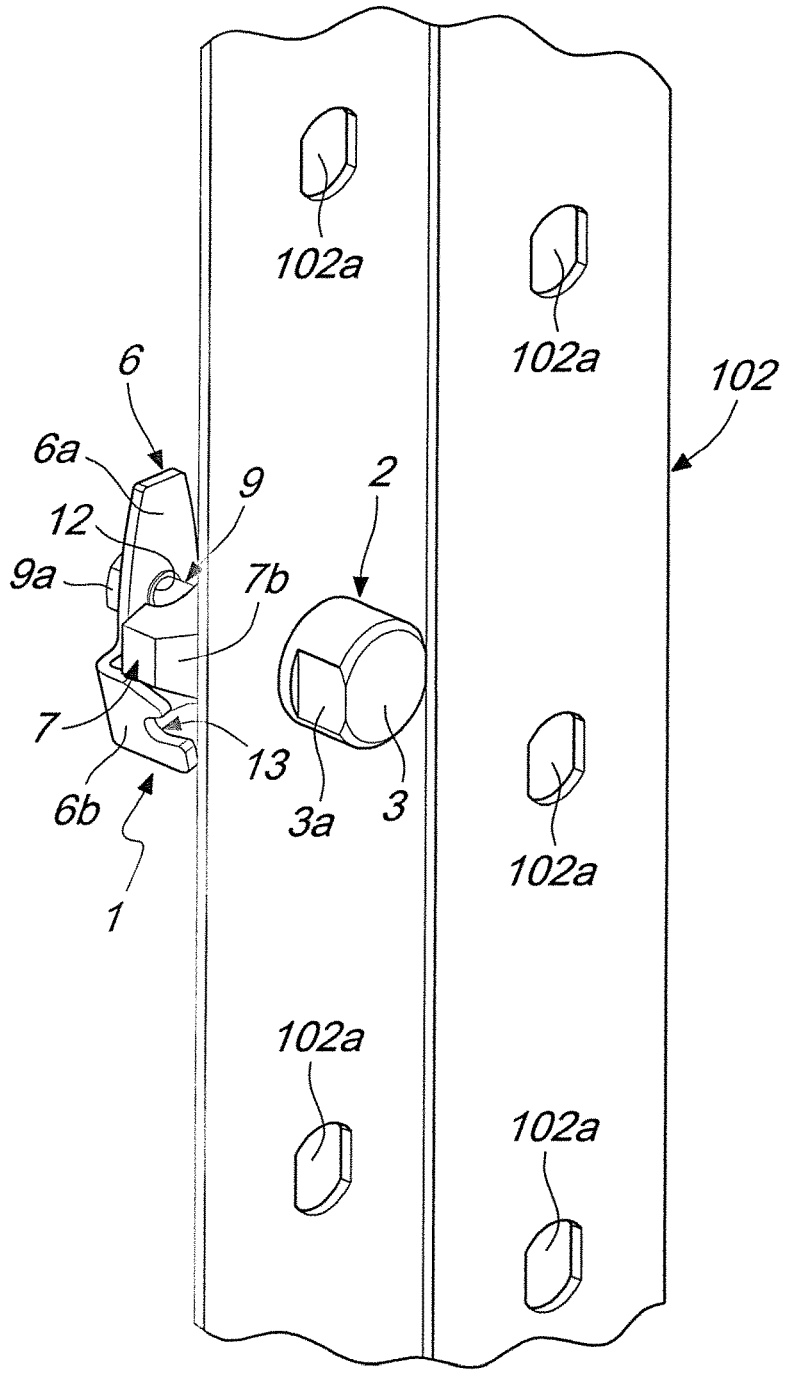
FIG. 20 is a greatly enlarged detail of FIG. 19.

The pin 2 has (a variable number of) lateral tabs 5 that can move elastically between a non-deformed configuration, in which they protrude from the lateral surface of the end portion of the shank 4 (FIG. 5), and at least one deformed configuration, in which they are kept inside the transverse space occupation of the shank 4. The tabs 5 are therefore arranged at a longitudinal height (with respect to the ideal direction of insertion into the hole 102*a*) such that, when the head 3 abuts against the post 102, they protrude from the shank 4 at the other side of the latter and therefore they oppose any extraction of the pin 2, thus guarding against its accidental loss (FIGS. 14 and 16 for example). Conversely, in the step of insertion into the hole 102*a*, the tabs 5 are automatically pushed toward the deformed configuration, in order to allow the coupling between the pin 2 and the post 102. In order to facilitate the automatic transition to the deformed configuration upon the progressive insertion of the shank 4 into the hole 102*a*, each tab 5 forms externally a form of outward-inclined ramp (FIG. 3), which abuts against the rim of the hole 102*a* during insertion and guards against the danger of excessively straining the tab 5 (or the rim of the hole 102*a*). The accompanying figures show a solution in which the shank 4 is provided with two tabs 5, but there can be any number of tabs 5.

The assembly 1 further comprises at least one clamp which in turn comprises a first jaw 6 and a second jaw 7 (FIGS. 6-10 for example). The second jaw 7 can be abutted with a base surface 7*a* thereof against the post 102 and has a recess 8 therealong (FIGS. 6, 7, 9, 10 for example) which is configured to receive the shank 4 (the end portion of it) with interference. So in fact, after the shank 4 has been inserted into the hole 102*a*, the second jaw 7 can be abutted (on the opposite side to the head 3) against the post 102, taking care to force the insertion of the shank 4 (the end portion) into the recess 8. The coupling with interference impedes the subsequent disengagement and therefore, in a manner similar to the tabs 5, guards against accidental loss.

Figure 2:
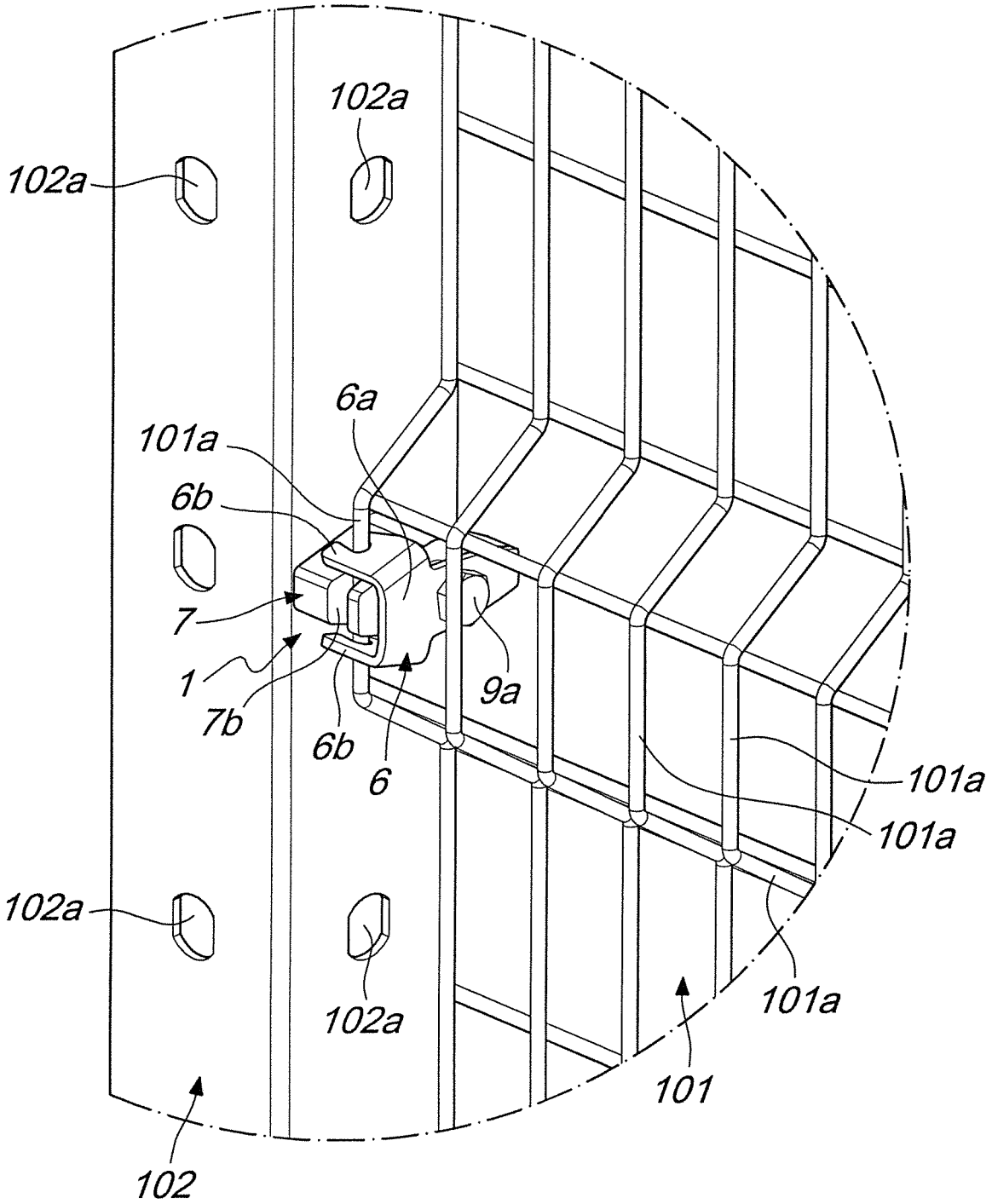
FIG. 2 is a greatly enlarged detail of FIG. 1 and shows an anchoring assembly.

The rigid wire 101*a* can be clamped between the jaws 6, 7, in a position that is spaced apart from the base surface 7*a* (and therefore from the post 102). In other words, and as can be seen in FIG. 2, the jaws 6, 7 are shaped so that, when they are brought together and mutually tightened, the respective areas for receiving and retaining the wire 101*a* are spaced apart from the base surface 7*a* (and from the post 102).

The assembly 1 also comprises at least one at least partially threaded stem 9, which can be inserted into the jaws 6, 7 and into the shank 4 until it is screwed into a female thread which is provided inside the pin 2 (and preferably inside its head 3), with consequent mutual tightening of the jaws 6, 7 and clamping in place of the rigid wire 101*a*. The insertion and therefore the screwing of the stem 9 respectively into the jaws 6, 7 and into the pin 2 obtain a plurality of results, enabling the assembly 1 to achieve the set aim. In fact, during the progressive insertion the stem 9 (with its enlarged tip 9*a*) makes the jaws 6, 7 approach each other until they are mutually tightened, thus enabling the clamping in place of the wire 101*a*. As the insertion continues (having first abutted the second jaw 7 against the post 102), the stem 9 is introduced into the female thread and so locks the jaws 6, 7 (and with them the wire 101*a*) to the post 102, in so doing obtaining the mutual anchoring of the latter and of the screen 101, thus ensuring the possibility of assembling the fencing 100.

In particular, the recess 8 has (preferably but not exclusively) a shape that is substantially complementary to that of the shank 4 (at least of its end portion). Furthermore, the recess 8 is provided, along its lateral surface, with a plurality of protrusions 10, for determining the reception with interference of the shank 4 in the recess 8. The possibility is not ruled out however of obtaining the coupling (the reception) with interference according to other practical methods, which in any case remain within the scope of protection claimed herein.

More specifically, in the embodiment illustrated in the accompanying figures for the purposes of non-limiting example of the disclosure (see in particular FIGS. 6, 7, 9, 10), each protrusion 10 is constituted substantially by an elongated ridge, which extends along the ideal direction of insertion of the shank 4 into the recess 8.

With further reference to the preferred, non-exclusive embodiment (and to FIG. 9), the recess 8 is provided with six ridges (protrusions 10), which are mutually parallel and distributed along the lateral surface of the recess 8. In any case it should be noted that it is possible to provide assemblies 1 that comprise any number of ridges, and/or other types of protrusions 10.

In a possible embodiment of the disclosure, of significant practical interest but which does not limit the application of the disclosure, the second jaw 7 comprises a block 7*b* which is provided with the base surface 7*a*. The block 7*b* is passed through by a through passage which defines, with one end portion, the recess 8 and is configured (is chosen to be of suitable dimensions) in order to allow the insertion of the stem 9.

It is to be noted that the block 7*b* has, in an upward region and in a downward region, wedge-shaped side walls, so as not to present horizontally-arranged surfaces when assembly of the fencing 100 is complete.

More specifically, the block 7*b* has a lateral groove 11, which is configured to accommodate a length of the wire 101*a*. Noting that typically the screens 101 are provided with wires 101*a* that are circular in cross-section, the groove 11 will also preferably have a circular/curvilinear bottom or progression, but the possibility is not ruled out in any case of adopting different shapes (for example a flat bottom), for wires 101*a* both with a circular cross-section and with another cross-section. In the embodiment in the accompanying figures the wire 101*a* is accommodated in a groove 11 which is arranged in a substantially intermediate position along the side of the block 7*b*. The possibility is not ruled out however of also receiving the wire 101*a* on the base of the block 7*b* opposite from the base surface 7*a* (so that the wire 101*a* is still kept spaced apart from the base surface 7*a* and from the post 102).

Conveniently, the first jaw 6 comprises a plate 6*a*, which can be applied to (pressed on) the second jaw 7 on the opposite side to the base surface 7*a*, by the action of the stem 9 (and of its tip 9*a* in particular), which can be inserted into a respective through orifice 12 provided along that plate 6*a* (until the tip 9*a* abuts against the latter).

The first jaw 6 further comprises at least one raised lug 6*b*, which extends substantially perpendicular from a margin of the plate 6*a* and has an indentation 13 (clearly visible for example in FIGS. 6-8), which is configured to accommodate a length of the wire 101*a* (different from the one that goes into the groove 11). Therefore, when the jaws 6, 7 are mutually tightened, against the wire 101*a* (against respective lengths) one flank (and/or the bottom) of the groove 11 press on one side, and the bottom (and/or one flank) of the indentation 13 press on the other side, so achieving the desired clamping in place by friction. It should be noted that in a manner similar to the groove 11, the profile of the indentation 13 can also preferably be chosen to be circular or in any case curvilinear, but other possibilities are not ruled out.

More specifically, in order to give greater stability to the clamping in place of the wire 101*a* and therefore of the mutual anchor point between the screen 101 and the post 102, the first jaw 6 comprises two (or even more) lugs 6*b*, which extend from two mutually opposite margins of the plate 6*a* and which have respective indentations 13 (for corresponding lengths of the wire 101*a*).

In the preferred embodiment, shown in the accompanying figures for the purposes of non-limiting example of the application of the disclosure, the head 3 of the pin 2 has a substantially cylindrical shape structure and is provided with two flattened-out lateral features 3*a*, in order to allow facilitated interaction with a manipulation tool (if required).

With further reference to such preferred shape, the shank 4 is constituted substantially by a hollow sleeve, which defines internally a channel 14 which is coaxially arranged in communication with the female thread of the head 3 (the female thread is not shown in the accompanying figures but its placement is entirely intuitive for a person skilled in the art in light of what has been explained up to this point). It is therefore the channel 14 that receives the stem 9, which is already inserted into the orifice 12 and into the through passage of the block 7*b*, in order to allow the coupling of the jaws 6, 7 to the pin 2.

More specifically, each tab 5 is elastically appended to an edge of a respective window 15, which is provided in a corresponding flattened-out portion of the lateral surface of the end portion of the shank 4. Each window 15 is effectively facing the channel 14 and when the tabs 5 are pushed toward the deformed configuration, they tend to return toward the channel 14.

As already anticipated, in addition to the assembly 1 a further object of the present discussion (and of the protection claimed herein) is a fencing 100 that comprises at least one laminar screen 101, which is provided with at least one rigid wire 101*a*, and at least one post 102, for supporting the screen 101 with vertical orientation.

The fencing 100 according to the disclosure therefore comprises an anchoring assembly 1 according to what is shown in the foregoing pages.

It is to be noted that the kit composed of a screen 101, a post 102 (or rather two posts 102) and one or more assemblies 1 that ensure their mutual anchor point effectively constitutes a basic modular unit, which can be repeated when desired to form enclosures 100 (which in any case remain within the scope of protection claimed herein) that are adapted to delimit areas with any perimeter, in terms of both shape and of dimensions (each post 102 can be associated with two or even more screens 101, side-by-side).

Therefore an object of the present discussion and of the protection that is claimed with it is also a kit for providing (assembling) enclosures 100, which comprises a plurality of laminar screens 101, each having at least one rigid wire 101*a*, a plurality of posts 102, each one for supporting at least one respective screen 101 with vertical orientation, and a plurality of anchoring assemblies 1 according to what is already explained in the foregoing pages.

In the kit, the installation technician can therefore find the screens 101 to be distributed as desired along the perimeter of interest, and also the posts 102 to be used to support them and the assemblies 1 for obtaining the anchoring.

The use of the assembly and of the fencing according to the disclosure have already been effectively explained in the foregoing pages, a brief summary is also given below.

Figure 13:
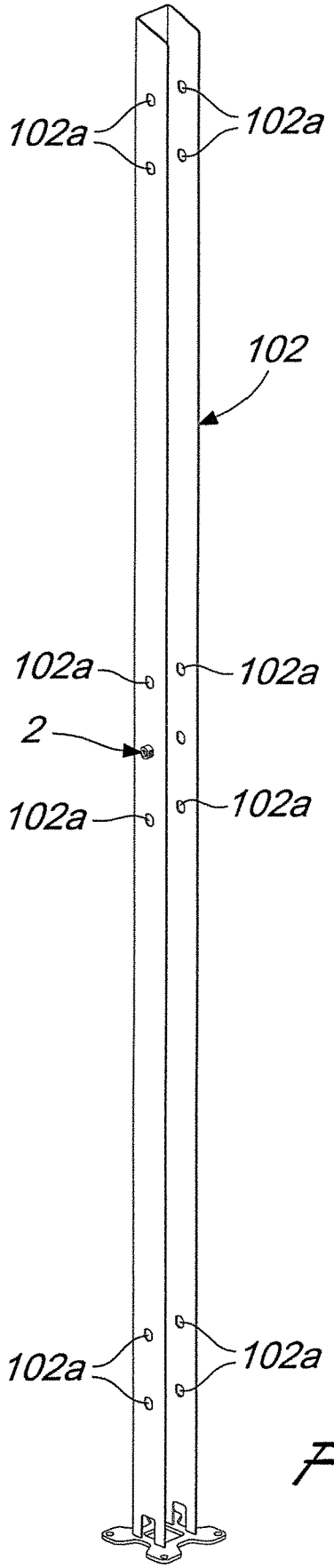
FIG. 13 is a perspective view of a first intermediate step of using an anchoring assembly to assemble the fencing in FIG. 1.

In order to obtain the assembly of a fencing 100, and in particular the mutual anchoring of a screen 101 and of a post 102, first of all the pin 2 needs to be inserted into a hole 102*a* of the post 102, until the head 3 abuts against it and so that the shank 4 exits on the other side (where the screen 101 is to be supported) with its end portion. The configuration in FIGS. 13-14 is accordingly obtained.

As already noted, during the insertion the tabs 5 are elastically deformed, automatically, in order to return later to the non-deformed configuration and oppose the subsequent extraction (which can happen only by pressing on the tabs 5).

Subsequently, the second jaw 7 can be abutted with its base surface 7*a* against the post 102, so that the shank 4 (its end portion) is inserted into the recess 8. The coupling with interference guards against the danger that the second jaw 7 might accidentally detach (disengagement can occur only by forcing the detachment of the second jaw 7).

Once this point has been reached, it is possible to locate a length of the wire 101*a* at the groove 11, by arranging the screen 101 in the vertical configuration that it is intended to assume when the fencing 100 is completed. It is emphasized again that the groove 11 is spaced apart from the base surface 7*a* and thus the wire 101*a* is kept spaced apart from the post 102.

To complete the clamping in place, the stem 9 needs to be inserted first into the orifice 12 of the first jaw 6 (of the first plate 6*a*), and then into the through passage of the second jaw 7 and into the channel 14 of the shank 4, and then it is screwed with a tool into the female thread provided in the pin 2. By means of screwing, the two jaws 6, 7 are mutually tightened (immobilizing the wire 101*a* between the groove 11 and the indentation 13), while the clamp (the jaws 6, 7 themselves) is in turn firmly pinioned to the pin 2. Such anchoring point can be removed only by using a tool to unscrew the pin 2.

In a mode of use that is absolutely equivalent, before positioning the wire 101*a* and the screen 101, it is possible to partially insert the stem 9 into the jaws 6, 7 (without causing the mutual clamping), and then place such jaws along the post 102 (effectively, as shown in FIGS. 15-18) and then proceed to place the wire 101*a* and the screen 101 and clamp them in place.

It should be noted that the accompanying FIGS. 1-2 show an embodiment in which each assembly 1 (there are 6 in the figures) acts on one of the outer (vertical) wires 101*a* of the screen 101. In an absolutely equivalent manner, for example by adequately dimensioning the block 7*b* and the position of the groove 11, the jaws can interact with a more inner vertical wire 101*a*. Or, by orienting the components of the assembly 1 differently (and optionally employing different parts of the groove 11 and of the indentation 13), the jaws can be deployed to clamp a horizontal wire 101*a*.

Thus it has been seen that the assembly 1 makes it possible to assemble a fencing 1 in a practical and rapid manner (by mutually coupling each screen 101 and the respective posts 102), by carrying out a few simple steps of short duration.

It is very important to note that by using the assembly 1, the wire 101*a* (and in general the screen 101) is kept at a distance from the post 102 and therefore in the fencing 100 according to the disclosure the zones of contact between different components are reduced to a small number (they are reduced effectively to the base surface 7*a*, which is of limited extent, and very little else). The wire 101*a* is in turn clamped only at small lengths which are trapped between the jaws 6, 7. At the same time, the block 7*b* preferably does not present horizontal surfaces (nor does the totality of the assembly 1, or the near-totality). In the assembly 1 and in the fencing 100 (and in the kit) according to the disclosure, both the areas in mutual contact and the horizontal surfaces (potential areas where bacteria and impurities can accumulate) are therefore very reduced, and this makes them easily washable and more generally fully adapted for use in buildings intended to be used in the food sector.

It should be noted that in order to be used in the food sector, all the components illustrated above of the fencing 100 and of the assembly 1 can be made of stainless steel, while not ruling out the use of other materials (metallic, polymeric, or of another nature).

It is likewise to be noted that the assembly 1 according to the disclosure is of the captive type, in that it is provided with contrivances (the tabs 5 and the protrusions 10 in particular) that are adapted to reduce or eliminate the risk of accidental disengagement and/or loss of its components.

The simplicity of the components and their practicality of use ensures the reliability of the assembly 1, which is shown to be versatile, it being possible to use it at any point of the post 102 and with different wires 101*a* (horizontal or vertical) of the screen 101.

Finally it should be noted that, in compliance with some regulations in the sector, the complete clamping in place (and release, if any) of the wire 101*a* can be done only with a tool (a wrench or a screwdriver) with which to cause the screwing or unscrewing of the stem 9.

The disclosure, thus conceived, is susceptible of numerous modifications and variations, all of which are within the scope of the appended claims. Moreover, all the details may be substituted by other, technically equivalent elements.

In the embodiments illustrated, individual characteristics shown in relation to specific examples may in reality be substituted with other, different characteristics, existing in other embodiments.

In practice, the materials employed, as well as the dimensions, may be any according to requirements and to the state of the art.

The invention claimed is:

1. An anchoring assembly for enclosures that comprise at least one laminar screen, which has at least one rigid wire, and at least one post, for supporting the screen with vertical orientation, and further comprising at least:

a pin provided with a head and with a shank, said shank being configured to be inserted into a hole which is provided along the post, until the head abuts on the post and an end portion of said shank exits on an opposite side, said pin having lateral tabs that can move elastically between a non-deformed configuration, in which they protrude from the lateral surface of said end portion of said shank, and at least one deformed configuration, in which they are kept inside a transverse space occupation of said shank, a clamp that comprises a first jaw and a second jaw, said second jaw being able to abut with a base surface thereof against the post and having a recess along said base surface which is configured to receive said shank with interference, it being possible to clamp the rigid wire in a position spaced apart from said base surface between said jaws, mutually tightened, and an at least partially threaded stem, which can be inserted into said jaws and into said shank until it is screwed into a female thread which is provided inside said pin, with consequent mutual tightening of said jaws and clamping in place of the rigid wire.

2. The anchoring assembly according to claim 1, wherein said recess has a substantially complementary shape to that of said shank and is provided, along a lateral surface thereof, with a plurality of protrusions, for receiving said shank in said recess with interference.

3. The anchoring assembly according to claim 2, wherein each one of said protrusions is constituted substantially by an elongated ridge, which extends along an ideal direction of insertion of said shank into said recess.

4. The anchoring assembly according to claim 3, wherein said recess has six said ridges, which are mutually parallel and distributed along said lateral surface of said recess.

5. The anchoring assembly according to claim 1, wherein said second jaw comprises a block which presents said base surface, said block being passed through by a through passage which, with one end portion, defines said recess and is configured for the insertion of said stem.

6. The anchoring assembly according to claim 5, wherein said block is provided with a lateral groove, which is configured to accommodate a length of the wire.

7. The anchoring assembly according to claim 1, wherein said first jaw comprises a plate, which is configured to be applied to said second jaw, on an opposite side to said base surface, by the action of said stem, which can be inserted into a respective through orifice provided along said plate, said first jaw comprising at least one raised lug, which extends substantially perpendicular from a margin of said plate and has an indentation, which is configured to accommodate a length of the wire.

8. The anchoring assembly according to claim 7, wherein said first jaw comprises two said lugs, which extend from two mutually opposite margins of said plate and have respective said indentations.

9. The anchoring assembly according to claim 1, wherein said head of said pin has a substantially cylindrical shape structure and is provided with two flattened-out lateral features, for facilitated interaction with a manipulation tool.

10. The anchoring assembly according to claim 1, wherein said shank is constituted substantially by a hollow sleeve, which defines internally a channel which is coaxially arranged in communication with said female thread of said head.

11. The anchoring assembly according to claim 1, wherein each one of said lateral tabs is elastically appended to an edge of a respective window, which is provided in a corresponding flattened-out portion of said lateral surface of said end portion of said shank.

12. A fencing comprising at least one laminar screen, which has at least one rigid wire, and at least one post, for supporting the screen with vertical orientation, and comprising at least one anchoring assembly according to claim 1.

13. A kit for providing enclosures, comprising a plurality of laminar screens, each having at least one rigid wire, a plurality of posts, each one for supporting at least one respective said screen with vertical orientation, and a plurality of anchoring assemblies according to claim 1.

* * * * *